United States Patent [19]

Prusas et al.

[11] Patent Number: 4,869,783

[45] Date of Patent: Sep. 26, 1989

[54] HIGH-YIELD CHEMICAL PULPING

[75] Inventors: Zenon C. Prusas; Clarence L. Oates, both of Chillicothe, Ohio

[73] Assignee: The Mead Corporation, Dayton, Ohio

[21] Appl. No.: 214,784

[22] Filed: Jul. 1, 1988

Related U.S. Application Data

[63] Continuation of Ser. No. 883,899, Jul. 9, 1986, abandoned.

[51] Int. Cl.[4] ..... D21B 1/04

[52] U.S. Cl. ..... 162/18; 162/24; 162/52; 162/56; 162/65; 162/88; 162/90

[58] Field of Search ..... 162/56, 52, 18, 9, 65, 162/88, 24, 90

[56] References Cited

U.S. PATENT DOCUMENTS

| | | | |
|---|---|---|---|
| 2,089,992 | 6/1937 | Campbell et al. | 8/2 |
| 2,422,522 | 3/1947 | Beveridge et al. | 92/6 |
| 2,829,049 | 1/1958 | Segl | 92/6 |
| 2,904,460 | 4/1959 | Nolan | 162/25 |
| 2,943,012 | 2/1960 | Dunning et al. | 162/18 |
| 3,016,324 | 9/1962 | Textor | 162/24 |
| 3,098,785 | 7/1963 | Meiler | 162/56 X |
| 3,192,102 | 12/1965 | Nolan | 162/24 |
| 3,811,993 | 5/1974 | Ghisoni | 162/56 X |
| 4,029,543 | 1/1977 | Lindahl | 162/24 |
| 4,050,980 | 4/1977 | Schmidt et al. | 162/24 |
| 4,088,528 | 2/1978 | Berger et al. | 162/19 |
| 4,235,665 | 7/1980 | Reinhall et al. | 162/23 |
| 4,247,363 | 1/1981 | Soma et al. | 162/28 |
| 4,372,495 | 11/1983 | Marton et al. | 241/28 |
| 4,372,810 | 9/1983 | Bystedt | 162/23 |
| 4,444,621 | 7/1984 | Lindahl | 162/26 |
| 4,486,267 | 4/1984 | Prusas | 162/25 |

FOREIGN PATENT DOCUMENTS

| | | | |
|---|---|---|---|
| 677418 | 1/1964 | Canada | 162/18 |

OTHER PUBLICATIONS

"Chip Destructing Improves Kraft Pulping", D. Lachenal, 1984 Pulping Conference, pp. 13–16.

*Primary Examiner*—Peter Chin
*Assistant Examiner*—Thi Dang
*Attorney, Agent, or Firm*—Smith & Schnacke

[57] ABSTRACT

A chemical pulping process is disclosed wherein wood chips are partially defiberized such that the fibers in the chips are substantially separated from one another but sufficient interfiber bonding is maintained to preserve chip integrity and thereby provide chips having an open porous fibrous network; and the chips are subjected to chemical pulping at an elevated temperature to remove a majority of the lignin in the chips.

10 Claims, 4 Drawing Sheets

HIGH-YIELD CHEMICAL PULPING

This is a continuation of co-pending application Ser. No. 883,899 filed July 9, 1986 now abandoned.

BACKGROUND OF THE INVENTION

The present invention relates to a chemical pulping process for the production of cellulose pulps. More particularly, the present invention relates to a modification of conventional chemical pulping processes which improves yield, reduces steam requirements, and produces a pulp which is more easily bleached and which possesses improved brightness stability.

Chemical pulping processes are characterized in that the wood fibers are released by dissolving the lignin which binds them together. Because lignin and other non-cellullosic portions of the wood chips are removed in the process, chemical pulping processes typically provide yields of 40–50% based on the dry chips.

The rate limiting step in any pulping process is the penetration of the pulping chemicals into the chips. While there are several theories for chip impregnation in chemical pulping, one theory is that the liquor diffuses through the network of chip lumen and pits to remove the lignin. A typical wood chip contains several million fibers depending on species and chip size. Each fiber is a miniature cylinder. The middle of that cylinder is the lumen. The lumen of each fiber is connected to the lumen of adjoining fibers by openings or windows called pits. Liquor penetration is limited by the microscopic size of the lumen and pits through the chip. Liquor in the lumen must still penetrate the fiber wall to remove the lignin in the middle lamella. Permeability of the fiber wall is poor and a significant portion of the wall must be dissolved to make it porous. This has two negative aspects, namely, loss of pulp yield due to loss of carbohydrates and contamination of the fiber wall with lignin degradation products. The latter makes the fiber difficult to bleach.

Efforts to improve chemical pulping processes by modifying the chip structure to expand its surface area and facilitate liquor impregnation have been made. D. Lachenal et al, "Chip Destructuring Improves Kraft Pulping", *TAPPI Proceedings*—1984 *Pulping Conf.* pp 13–16, reports that destructing chips by passage through crush rollers reduces rejects. Nolan, in U.S. Pat. Nos. 2,904,460 (1959) and 3,912,102 (1965) teaches shredding the chips along the grain to facilitate chip impregnation. A hammer mill, attrition mill or crushing roll is used to shread the chip. Nolan states that a single fiber would be the most efficiently tailored chip from a purely theoretical standpoint, but this results in severe fiber damage and unacceptable loss in pulp strength. Nolan's preferred chip is a pin chip which ranges from about 2.3 to 6.7 mm in cross-section.

Chip destructuring as taught by Lachenal and Nolan does not form the open porous network which characterizes the chip used in the present invention and only marginally improves chemical pulping. Consequently it is not widely practiced in the paper industry.

SUMMARY OF THE INVENTION

A principal object of the present invention is to improve yield, H factor requirements and bleachability of a chemical pulp through chip destructuring and, more particularly, through partial chip defiberizing.

In accordance with the present invention, wood chips are subjected to a combination of compressional and torsional forces to achieve partial separation of the fibers in the chip; i.e. partial defiberizing. By "partial defiberizing" is meant that millions of fibers present in the chip are largely mechanically separated from each other over the major part of their length and yet they are still bonded to one another at some point or points along the fiber length, preserving the structural integrity of the chip. This is in contrast to complete (total) defiberizing where chips are reduced to individual fibers which are not connected to each other, for example, in RMP or in TMP processes. A bulky chip having an open, porous and fibrous network is obtained according to the teachings of the present invention.

The chip treatment in accordance with the present invention also differs from that referred to in commonly assigned U.S. Pat. No. 4,486,267 in which no attempt was made to reduce the chip to individual fibers. There, the objective is merely to compress partially destructured or not destructured chips and to allow them to expand in a caustic solution, as a way of improving penetration of the chips by this solution in a CTMP process. In CTMP processes, caustic swells and thus weakens the hemicellulose-rich P and $S_1$ layers of a fiber (see the discussion of FIG. 3 below). This insures that the separation of fibers in the defiberizing step (which follows a second impregnation stage) takes place along the P and $S_1$ layers and not along the lignin-rich middle lamella, as is the aim of the present invention. Because no subsequent delignification takes place after defiberizing according to U.S. Pat. No. 4,486,267, if fiber separation occurred along the middle lamella, lignin located on the surfaces of the fibers would prevent hydrogen bonding between individual fibers when the fibers are formed into a sheet structure and sheet strength would be poor. In contrast, the objective of the present invention is to separate fibers along the middle lamella to facilitate the removal of lignin in subsequent cooking.

By partially defiberizing the chip but not completely separating the fibers, several advantages are achieved. Partial defiberizing of the chip opens up the middle lamella such that the cooking chemicals can act on the middle lamella directly without passing through the fiber wall. Chip penetration is not limited to the pit and lumen network of the chip. The chip appears as a loosely packed network of fibers having a coating of lignin on the outer surface which is readily accessible to the pulping liquor. As a result, Kappa levels of 50 to 70 are achieved very efficiently. For example, in Kraft pulping an H factor of only about 160 is required to lower the Kappa number from an estimated level of 150 to 65 (a 57% reduction in lignin). This compares with an H factor of 400 which would be required to delignify conventional chips to a Kappa number of 65.

Because the cooking liquor can directly access the lignin in the middle lamella without passing through the fiber wall, less carbohydrate is removed in the pulping process and yields are concomittantly higher. The fibers also produce bulkier paper which is a desirable characteristic in tissue, towel and book paper grades. Similarly, because the liquors can directly access the fiber wall, fewer lignin byproducts are left in the wall itself and the pulp has better bleachability. Finally, whereas chemical pulping of a completely defiberized chip requires a very high liquor to wood ratio and can not be performed in a conventional digester, the partially defiberized chip can be pulped at conventional or nearly conventional liquor to wood ratios in conventional digesters. Consequently, minimum capital expense is involved in modifying a pulp mill to carry out the process of the present invention.

Thus, the present invention provides a chemical pulping process which comprises:

partially defiberizing wood chips such that the fibers in the chips are substantially separated from one another but sufficient bonding points are maintained to preserve chip integrity and thereby provide a chip having an open porous network, and subjecting the destructured chips to a chemical pulping liquor to remove a majority of the lignin therefrom.

It has been found that it is usually desirable to terminate the cook at Kappa levels greater than 40 and typically about 45 to 70 and to use other processes such as oxygen delignification to complete delignification, e.g., to reduce Kappa to about 15 to 25 prior to bleaching depending upon the intended use of the pulp. Oxygen is generally preferred to other delignification processes because it is less expensive and the waste liquor can be concentrated and recycled to the chemical recovery. When delignification is completed the pulp is bleached in an otherwise conventional manner. Thus, a preferred pulping process in accordance with the present invention comprises:

partially defiberizing wood chips such that the fibers in the chips are substantially separated from one another but sufficient interfiber bonding points are maintained to preserve chip integrity and thereby provide a chip having an open porous, fibrous network;

subjecting said partially defiberized chips to chemical pulping at elevated temperature and pressure to provide a pulp having a Kappas value of about 45 to 70;

further delignifying said pulp with caustic in the presence of oxygen to provide a pulp having a Kappa value of about 15 to 25; and bleaching said pulp.

DEFINITIONS

The terms "chemical pulping" and "chemical pulping liquor" are used herein as they are used in the art, namely, to refer to chemical pulping processes such as the Kraft, soda, soda AQ (anthraquinone), Kraft AQ, sulfite, bisulfite processes and others. See Rydholm, *Pulping Processes*, Interscience Publishers, p. 284, Table 6.1, (1965). These processes are characterized by lignin removal in excess of 50% and often 75 to 90% and yields of 40 to 60%.

DETAILED DESCRIPTION OF THE INVENTION

Figure 3:
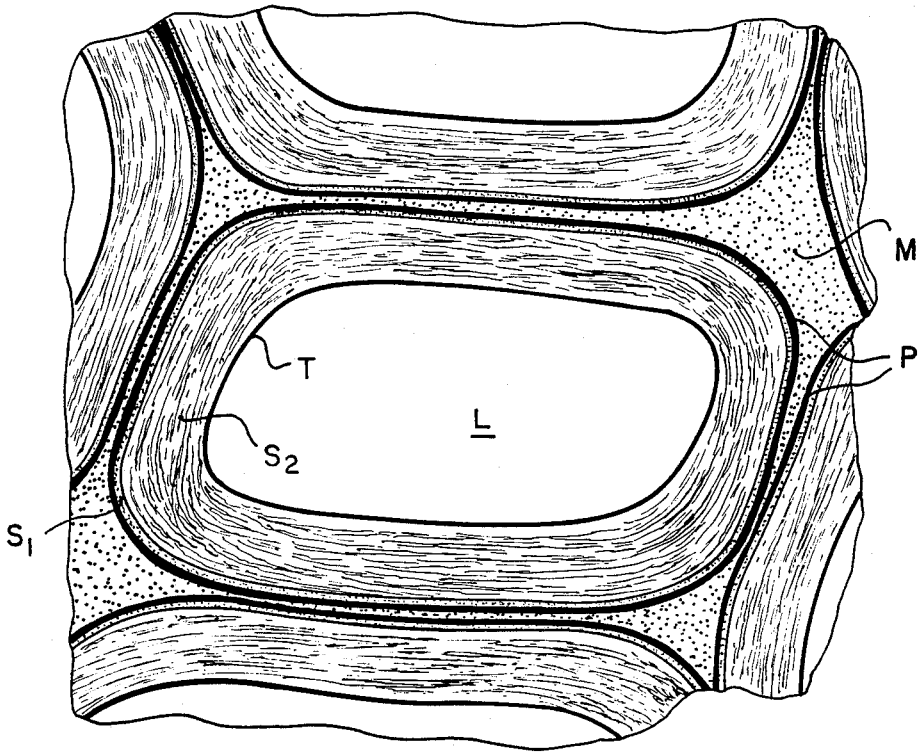
FIG. 3 is a schematic illustration of the cross-section through a pulp fiber.

FIG. 3 is a cross-section of a wood fiber. Lignin is most concentrated in the middle lamella (M). To delignify a chip, liquor passing through the lumen (L) must dissolve the tertiary layer (T), the secondary layers ($S_1$ and $S_2$) and the primary layer (P). Lignin from the middle lamella (M) can then be removed by the liquor to the lumen (L) which acts as a miniature pipe for transportation of liquids.

Figure 1:
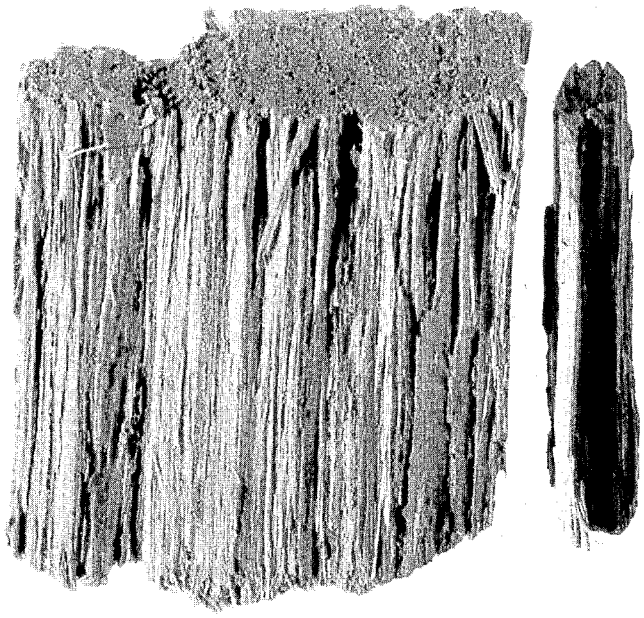
FIG. 1 is a photograph of a conventional chip and a pinchip (upper part of the photograph), and a destructured chip for pulping in accordance with the present invention (lower part of the photograph)
Figure 1:
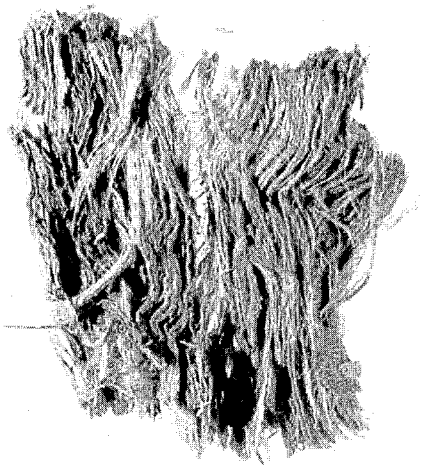
Figure 2:
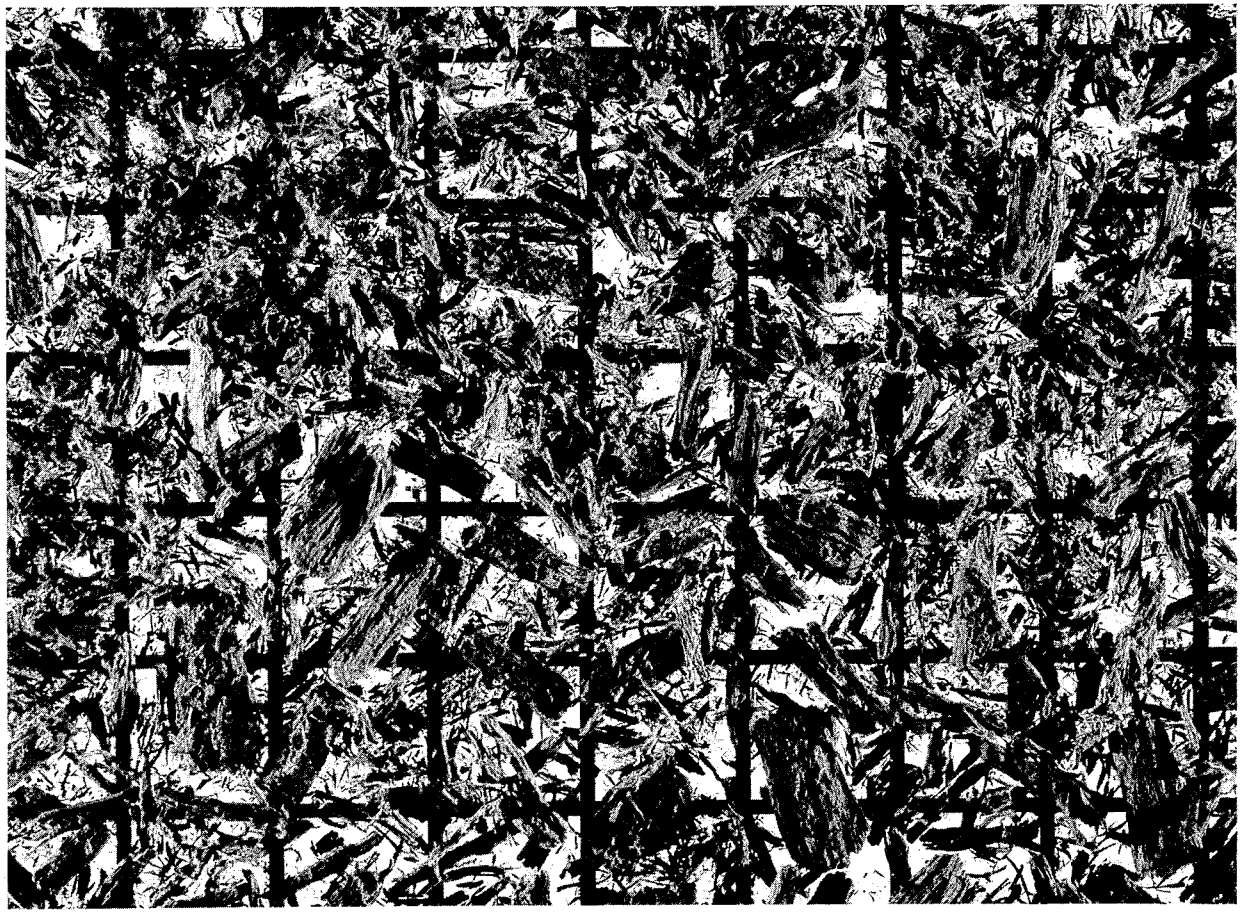
FIG. 2 is a photograph of a plurality of chips for chemical pulping in accordance with the present invention.

A wood chip for chemical pulping in accordance with the present invention is shown in FIG. 1 (bottom) and is characterized by the open porous fibrous network. This network is obtained by acting on the chip with a combination of compressional and torsional forces such as can be obtained in a screw press and, more particularly, by operating the screw press at a high compression ratio and under a high back pressure. The screw press operating conditions will vary with the nature of the chip and, more particularly with the type of wood (e.g., hardwood or softwood), its age and dryness. The objective of any such operation is to produce chips essentially as shown in FIG. 2. In addition to a screw press, other mechanical devices which are capable of subjecting chips to twisting, bending and compressing actions can also be used to obtain a partially defiberized chip; for example, screw extruders can be used. Commercial pulping digesters are frequently equipped with feed screws, however, they are not operated under a substantial back pressure and they are not used to destructure the chips as in the present invention.

In order to obtain good fiber separation, it is desirable to expose the chips to steam before destructuring them and to operate the screw press or other destructuring means at temperature above 100° C. Pre-streaming softens the middle lamella and makes the fibers easier to separate. It is particularly desirable to heat the screw press or other destructuring unit to temperature in excess of 100° C. such as 120°–160° C.

Chips pre-treated in accordance with the present invention are friable. That is they can be crumbled by pressing and rolling the chip between the thumb and index finger.

To illustrate the differences between chips destructured as shown in FIGS. 1 (bottom) and 2 and chips destructured by other means, destructured chips were classified by size after destructuring on a hammermill, a roll press, and an attrition mill, versus a heated and unheated screw press in accordance with the present invention. To further demonstrate the extent of destructuring, the chips were treated in a British disintegrator, a standard laboratory tool used to disintegrate drylap pulp and waste paper into individual fibers without shortening fiber length and without refining fibers. The disintegrator was operated at 2.0% consistency for 1 hour. The results are shown in Table 1.

TABLE 1

| Chip Treatment Typegrams | Chip Classifications by Size (Percent) Larger than 6.7 mm (chips) | 1.65–6.7 mm (pinchips) | Smaller than 1.65 mm | 0.2 mm (shives) | On 150 mesh (fibers) | Through 150 mesh (fines) | Total |
|---|---|---|---|---|---|---|---|
| Before British Disintegrator | | | | | | | |
| Untreated | 94.0 | 5.5 | 0.5 | — | — | — | 100 |
| Hammermill | 76.9 | 22.3 | 0.8 | — | — | — | 100 |
| Roll Press | 90.6 | 8.3 | 1.1 | — | — | — | 100 |
| Attrition mill | 24.4 | 66.9 | 8.7 | — | — | | 100 |
| Screw press, no heating | 59.4 | 27.7 | 12.9 | — | — | — | 100 |
| Screw press + heat | 48.9 | 37.4 | 13.7 | — | — | — | 100 |
| After British Disintegrator | | | | | | | |
| Untreated | 52.2 | 16.0 | — | 17.8 | 5.4 | 8.6 | 100 |
| Hammermill | 37.9 | 34.7 | — | 15.8 | 3.5 | 8.1 | 100 |
| Roll press | 5.5 | 54.3 | — | 27.1 | 3.9 | 9.2 | 100 |
| Attrition mill | 2.5 | 57.2 | — | 27.7 | 3.8 | 8.8 | 100 |
| Screw press, no heat | 3.6 | 32.4 | — | 43.4 | 8.4 | 12.2 | 100 |
| Screw press + heat | 1.4 | 12.8 | — | 50.9 | 21.2 | 13.7 | 100 |

It can be seen from Table 1, that in the case of the untreated, hammermill, and roll crushed chips, about 99% of the material is larger than 1.65 mm (the size of a pin chip), compared to 86% in accordance with the present invention and 91% in the case of the attrition mill.

The difference in the chips is more clearly shown after treatment in the disintegrator. Each chips was subjected to the same conditions in the disintegrator. In this case in accordance with the present invention only 14% of the chip material is larger than 1.65 mm in width when the screw press is heated (36% when the press is not heated) compared to 60–70% in the case of the other materials.

The difference in the chips is also illustrated by comparing their surface area as measured by BET nitrogen adsorption. The results of this study are shown in Table 2. Surface area was determined by dynamic gas fllow technique (Stone J. E. and Nikerson L. F., "A Dynamic Nitrogen Adsorption Method for Surface Area Measurements," Pulp and Paper Magazine of Canada, March 1963).

TABLE 2

| Chip Treatment | Surface Area (M2/g) |
|---|---|
| Hammermill | 0.238 |
| Roll Press | 0.238 |

TABLE 2-continued

| Chip Treatment | Surface Area (M2/g) |
|---|---|
| Attrition Mill | 0.262 |
| Screw Press (no heat) | 0.487 |
| Screw Press (heated) | 0.549 |

The data in Table 2 show that the chips destructured in a screw press in accordance with the present invention have a significantly higher surface area than chips treated by other processes.

Density measurements and compaction studies also illustrate the properties of the destructured chips used herein. The chip density was obtained for soaked chips following TAPPI Method T258 om-85 by determining oven dry wood weight and displacement of the chips in water. In addition the densities of the destructured chips were determined for the compacted and uncompacted chips. For the latter measurement, a known weight of destructured chips was allowed to fall into a metal cylinder and the volume measured. In the former the cylinder was vibrated until the chips settled and there was no change in volume and the volume was measured. The results are shown in Table 3.

TABLE 3

| | Density and Compaction Characteristics Untreated | Hammermill | Roll Press | Attrition Mill | Screw Press | Screw Press + Heat |
|---|---|---|---|---|---|---|
| | Chip Density (After 10 days soak) - Wet Chips - lbs/ft.$^3$ | | | | | |
| | 36.5 | 34.6 | 31.7 | 29.0 | 23.8 | 21.1 |
| Air Dried Samples: | | | | | | |
| Uncompacted, lbs/ft$^3$ | 15.4 | 14.8 | 13.8 | 10.0 | 10.6 | 10.2 |
| Compacted, lbs/ft$^3$ | 20.2 | 19.0 | 17.2 | 12.7 | 13.4 | 12.2 |
| Ratio Compacted/Uncompacted | 1.31 | 1.29 | 1.25 | 1.26 | 1.26 | 1.20 |
| Moisture Content, % | 12.0 | 8.6 | 12.6 | 7.1 | 16.1 | 10.0 |
| Oven Dried Samples: | | | | | | |
| Uncompacted, lbs/ft$^3$ | 13.6 | 13.5 | 12.1 | 9.3 | 8.9 | 9.1 |
| Compacted, lbs/ft$^3$ | 17.8 | 17.4 | 15.1 | 11.8 | 11.2 | 11.0 |
| Ratio Compacted/Uncompacted | 1.31 | 1.29 | 1.25 | 1.26 | 1.26 | 1.20 |

The results show that the chips destructured in accordance with this disclosure are much bulkier than those treated by attrition mill, hammermill or roll press. The hammermill chips are similar to untreated chips indicating that very little was done to the chips in hammermilling.

Based on the foregoing studies, it has been determined that the destructured chips of FIG. 1 and 2 can be further characterized, in accordance with the more preferred embodiments of the invention, as having a surface area of at least 0.30 $m^2/g$ and preferably at least 0.40 $m^2/g$ as determined by the dynamic gas flow technique. Alternatively, and/or additionally, the preferred chips are characterized by density, as determined by TAPPI method T258 om-85, which is 20 to 30% lower than the untreated chip. The preferred chip structure can be further characterized by British Disintegrator Test where less than about 40% of the disintegrated chips are greater than 1.65 mm in size and preferably less than 20% of the disintegrated chips are greater than 1.65 mm in size.

Chips destructured as described above can be pulped using conventional or known chemical pulping processes. In Kraft or soda digestion operations, the chips are digested with a liquor consisting of sodium hydroxide alone or in combination with sodium sulfide. In acid sulphite operations the cooking liquor is a mixture of sulphurous acid and sodium, magnesium or calcium sulfite. Alkaline sulfite cooking is preformed with a cooking liquoor containing sodium sulfite and sodium hydroxide. In bisulphite operations the cooking liquor is a mixture of sulphurous acid and sodium bisulfite. Anthraquinoine can be used in these processes to further improve the pulp. Pulping may be carried out in a batch or continuous operation. Typical pulping conditions are temperatures in excess of 130° C. and pressure of 30 to 80 psig. Chips destructured in accordance with the present invention are particularly desirable for use in vapor phase cooking.

As indicated previously, it is not desirable to reduce Kapp below about 30 to 40 by cooking. Instead, Kappa should be reduced to about 50 and then the pulp should be delignified further under milder conditions. As a corollary, cooking conditions (temperature and time) are preferably limited such that the H factor does not exceed about 400. With conditions (temperature/time) which provide a higher H factor or ower Kappa, the strength of the pulp is often reduced. Thus, it is desirable jto further delignify the pulp under conditions which lower Kappa without sacrificing strength.

It is preferred to further delignify the pulp by a process such as oxygen delignification which retains strength. Oxygen delignification usually involves the addition of caustic to the pulp to raise the pH to about 11 and reacting the pulp with oxygen. Oxygen delignification is well known in the art and is described in U.S. Pat. Nos. 3,832,276 to Roymoulik et al; 2,926,114 to Grangaard; and 3,754,417 to Jamieson. In this stage of the process, Kappa is typically reduced to 15 to 25 and will depend on the end use.

After delignification, the pulp is bleached in a conventional manner. Typically the pulp is chlorinated using either chlorine, chlorine dioxide, or a mixture of chlorine and chlorine dioxide, but other processes can also be used. Bleaching is usually conducted as a bleaching sequence such as $C_DED$, $C_DEDED$, CED, etc.

The process of the present invention can be used on softwoods and hardwoods, but preliminary indications are that little, if any, improvement in yield is obtained on softwood.

Figure 4:
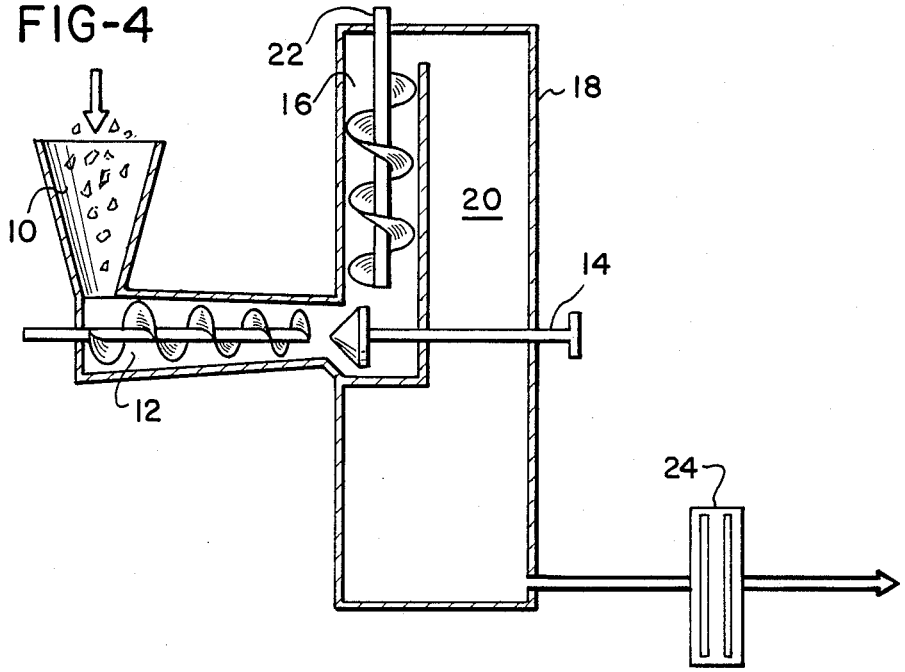
FIG. 4 is a schematic illustration of a digester for performing the process of the present invention.

FIG. 4 is a schematic illustration of a pulping apparatus for use in the present invention. Wood chips are fed from a hopper pin 10 to a screw press 12 equipped with a plug former 14 for applying a back pressure to the chips as they pass through the press 12. The press 12 destructures the chips as shown in FIG. 2 and feeds them into compartment 16 in continuous vapor phase digester 18. Chips fed to compartment 16 are conveyed into the main digester tank 20 by a feed screw 22. Because the chips are not completely defiberized as they are fed to the digester, it is generally necessary to refine the pulp after it is blown from the digester 18. For this purpose a conventional pressurized refiner or defibrator 24 is used. The resulting pulp is washed and is further processed, e.g., in oxygen delignification and in bleaching steps.

Screwpress 12 and plug former 14 are operated so as to partially defiberize the chips. Depending on the nature of the chips, the screwpress 12 is equipped with a screw having a compression ratio of 3/1 to 5/1. Typically, dense hardwoods can be adequately destructured using a screw compression ratio of 3/1. Softwoods and low density hardwoods often require a higher compression ratio, for example 4/1 or 5/1. Normally the compression ratio when feeding chips in conventional processes is 2/1. The back pressure applied by the plug former in the invention is substantial. Typically it is about 100–200 psi. This compares with 35 to 75 psi pressures normally employed while feeding chips into a continuous digester.

The partially defiberized chips appears to be more susceptible to high temperature, than a less destructured chip. As such, it is desired to use milder cooking temperatures in the present invention. Temperatures of about 140° to 160° C. are preferred depending on the nature of the wood and the degree of delignification desired. In conventional chemical pulping temperatures of 170° C. or higher are typically used.

The properites of chemical pulps obtained in accordance with the present invention are summarized below.

Figure 5:
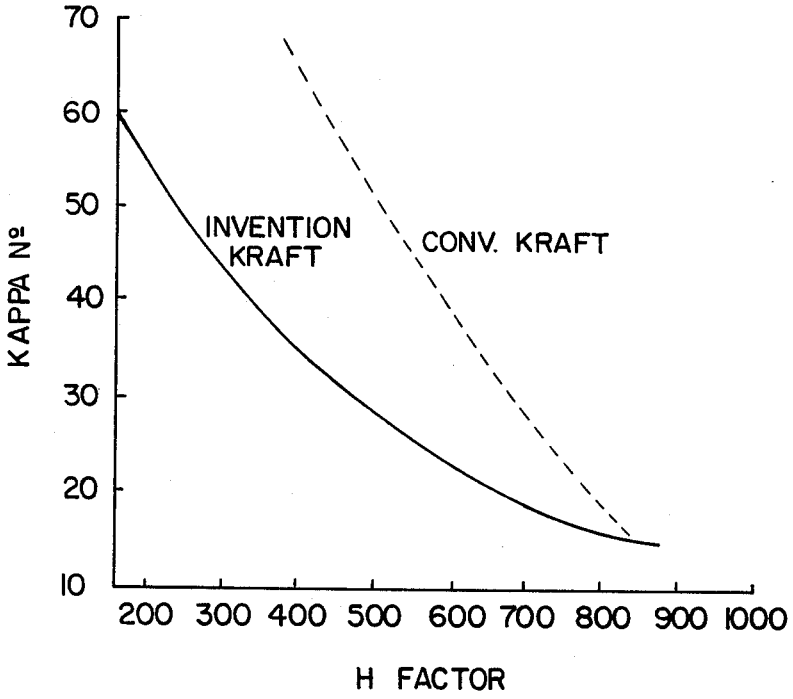
FIG. 5 is a graph of H factor vs. Kappa number for a Kraft pulp in accordance with the invention and a conventional Kraft pulp.

FIG. 5 illustrates the relationship between H factor and Kappa for a Kraft process in accordance with the present invention and a conventional process. As illustrated in FIG. 5, very efficient removal of lignin takes a place in the beginning of the cook in accordance with the invention. For example, in a Kraft process an H factor of only 160 is required to lower the Kappa number from an estimated 150 level to 65, or to reduce the lignin content by about 57% compared to an H factor of 400 required for conventional chips. Further removal of lignin requires much higher levels of H factor, especially at Kappa levels lower than 30. At Kappa number levels below 20, the H factor requirements can be almost as high as those required in conventional cooking. Thus, it is desirable to terminate the cook at Kappa levels higher than 30 preferably at about 50, or at residual lignin above 5%, and to complete delignification with oxygen and with conventional bleaching chemicals.

Table 4 compares bleached pulp properties on oak between a conventional Kraft pulp and a pulp in accordance with the invention. Bleached viscosity of conventional cook was very high (31.9 cps). Viscosities of invention cooks were much lower (15.0–15.3). It is suspected that the oxygen stage before $C_DED$ bleaching may have contributed to lower viscosity. For example, on cook No. 2, bleached viscosity was 21.5 when oxygen stage was omitted compared to 15.3 cp when oxygen stage was used. There was no oxygen stage for the conventional cooks.

TABLE 4

KRAFT: CONVENTIONAL VS. INVENTION PLUS $O_2$ DELIGNIFICATION $C_DED$ BLEACHING SEQUENCE

| Type of Cooking | Conv. | Invention | |
|---|---|---|---|
| Cook No. | 1 | 2 | 3 |
| H Factor | 845 | 401 | 213 |
| Kappa number, brownstock | 16.7 | 29.6 | 51.2 |
| Number of $O_2$ stages | 0 | 1 | 2 |
| K No. after $O_2$ Stage | 11.9 | 9.7 | 11.4 |
| Bleached brightness | 89.0 | 90.2 | 91.2 |
| PC No. | 3.49 | 2.54 | 2.61 |
| Viscosity, cps | 31.9 | 15.3 | 15.0 |
| Refined C.S. freeness, ml | 405 | 405 | 390 |
| Drainage time, secs | 5.6 | 5.1 | 5.1 |
| Bulk, cc/g | 1.60 | 1.68 | 1.59 |
| Tear factor | 103 | 84 | 86 |
| Burst factor | 34.7 | 27.0 | 31.9 |
| Tensile, b.l.m. | 5800 | 4670 | 5000 |
| TEA, fp/ft.$^2$ | 5.76 | 5.96 | 5.83 |
| $Log_{10}$ MIT fold | 1.491 | 1.204 | 1.301 |
| Opacity | 74.4 | 75.3 | 73.7 |
| 100 S | 3.34 | 3.54 | 3.30 |
| PPS @ 10#, Wire | 4.6 | 5.2 | 5.0 |
| Felt | 8.1 | 8.4 | 7.8 |

Brightness was higher (90.2–91.2 vs. 89.0). Tear, burst and tensile values were lower by almost 20% when the cooking was terminated at 30 Kappa, and 10–15% lower when stopped at 50 Kappa. TEA (tensile energy absorption) was comparable or slightly higher than for the conventional pulp. It is believed that the strength properites of the pulps could be brought close to those of conventional pulp with the help of a longer, lower temperature cook.

Table 5 shows a compaison between oak conventional and soda AQ pulps in accordance with the invention. As in the case of Kraft, bleached viscosities were much lower than those of conventionally cooked pulps (10.8–13.4 cps vs. 27.6 cps). Poor control in oxygen stage and higher brightness (88.9–89.4 vs. 85.3) could have contributed to this result. Strength properties approach those of conventionally cooked pulp when the cook is terminated at Kappa number of 64 but are lower by 12–27% when the cooking proceeded to Kappa number of 27.4.

TABLE 5

SODA AQ: CONVENTIONAL VS. INVENTION PLUS $O_2$ DELIGNIFICATION $C_DED$ BLEACHING SEQUENCE

| Type of Cooking | Conv. | Invention | |
|---|---|---|---|
| Cook No. | 4 | 5 | 6 |
| H Factor | 1487 | 398 | 172 |
| Kappa number, brownstock | 18.4 | 27.4 | 64.0 |
| Number of $O_2$ stages | 0 | 1 | 2 |
| K No. after $O_2$ Stage | 13.0 | 9.0 | 12.4 |
| Bleached brightness | 85.3 | 88.9 | 89.4 |
| PC No. | 4.32 | 1.36 | 1.71 |
| Viscosity, cps | 27.6 | 13.4 | 10.8 |
| Refined C.S. freeness, ml | 410 | 410 | 400 |
| Drainage time, secs | 5.5 | 5.2 | 5.1 |
| Bulk, cc/g | 1.57 | 1.75 | 1.67 |
| Tear factor | 97 | 85 | 83 |
| Burst factor | 33.3 | 24.4 | 31.3 |
| Tensile, b.l.m. | 5980 | 4360 | 5160 |
| TEA, fp/ft.$^2$ | 5.79 | 5.29 | 6.75 |
| $Log_{10}$ MIT fold | 1.556 | 1.041 | 1.398 |
| Opacity | 74.8 | 75.9 | 73.0 |
| 100 S | 3.39 | 3.61 | 3.18 |
| PPS @ 10#, Wire | 4.4 | 5.7 | 5.4 |
| Felt | 8.1 | 8.0 | 8.1 |

Table 6 compares conventional cooking and cooking in accordance with the invention for regular oak soda. The invention gives a much lower viscosity (8.4 vs. 16.4) and a lower pulp strength. One reason is that more than two times higher H factors and thus much higher temperatures were required in soda than in soda AQ and Kraft cooking to achive a given Kappa number. This undoubtedly decreases pulp strength. In general, it appears that the partially defiberized chips used in the present invention are less suitable for soda than for soda AQ or Kraft cooking.

TABLE 6

SODA COOKING: CONVENTIONAL VS. INVENTION PLUS $O_2$ DELIGNIFICATION $C_DED$ BLEACHING SEQUENCE

| Type of Cooking | Conv. | Invention |
|---|---|---|
| Cook No. | 7 | 8 |
| H Factor | 1878 | 632 |
| Kappa No., brownstock | 18.1 | 42.5 |
| Number of $O^2$ stages | 0 | 1 |
| K No. after $O^2$ stage | 13.0 | 12.0 |
| Bleached brightness | 83.3 | 88.7 |
| PC No. | 4.86 | 2.68 |
| Viscosity, cps | 16.4 | 8.4 |
| Refined C.S. freeness, ml | 410 | 395 |
| Drainage time, secs. | 5.3 | 5.0 |
| Bulk, cc/g | 1.62 | 1.76 |
| Tear factor | 97 | 75 |
| Burst factor | 31.0 | 22.9 |
| Tensile, b.l.m. | 5490 | 4050 |
| TEA, fp/ft.$^2$ | 5.41 | 4.49 |
| $Log_{10}$ MIT fold | 1.301 | 0.903 |
| Opacity | 76.1 | 77.5 |
| 100 S | 3.56 | 3.89 |
| PPS @ 10#, wire | 4.6 | 5.5 |
| felt | 8.1 | 8.4 |

The following non-limiting examples further illustrate the preferred embodiments of this invention and the advantage obtained thereby. All pulp tests were performed in accordance with TAPPI standard testing procedures.

EXAMPLE 1

Commerical Appalachian hardwood chips containing a high percentage of oak were partially defiberized in a Sunds Defibrator's PREX unit while feeding a continuous experimental digester at a 0.8 lbs. min. rate (O.D. basis). Cooking conditions were:

| | |
|---|---|
| Active alkali | 14% |
| Sulfidity | 24.4% |
| Cooking Time | 30 min. |
| Cooking Temperature | 150° C. |
| H Factor | 122 |
| Kappa No. | 71.5 |

The pulp was washed and further delignified in two stages of oxygen treatment and then bleached in three stages of bleaching (chlorination, extraction and chlorine dioxide).

Conditions for a comparison cook made in a batch digester using conventional technology were as follows:

| | |
|---|---|
| Active Alkali | 17.5% |
| Sulfidity | 30% |
| Time to Temperature | 90 min. |
| Time at Temperature | 40 min. |
| Cooking Temperature | 168° C. |
| H Factor | 717 |
| Kappa No. | 19.8 |

The resulting brownstock was bleached in four bleaching stages (chlorination, extraction, hypochorite and chlorine dioxide). Pulp properites were as follows:

TABLE 1

| | Conventional | Invention |
|---|---|---|
| Bleached Yield, % | 45.2 | 50.6 |
| Pulp Brightness | 87.6 | 90.8 |
| C.S. Freeness, ml | 400 | 400 |
| Tensile Index, Nm/g | 51.0 | 47.2 |
| Burst Index, kPam$^2$/g | 4.11 | 4.03 |
| Tear Index, mN.m$^2$/g | 8.7 | 7.3 |
| Tensile Energy Absorbtion, J/m$^2$ | 56.0 | 56.3 |
| Apparent Density, g/cc | 0.64 | 0.63 |

The results in this table show a bleached pulp yield gain of 5.4% based on wood, or a 12% gain based on pulp, compared to the conventional technology. Brightness is also higher for pulp made according to the teachings of this invention. Other pulp properties appear to be similar, despite a higher pulp yield and a higher brightness level of the invention pulp. A major reduction in H factor (from 717 to 122) is indicated, which results in a major saving in energy (stream) during cooking.

EXAMPLE 2

Northern hardwood chips consisting primarily of hard and soft maples, aspen and birch were partially defiberized while feeding a Sunds Defibrator's experimental continuous digester at a 0.44 lbs/min (O.D. basis) feeding rate.

Cooking conditions were:

| | |
|---|---|
| Active Alkali | 15.9% |
| Sulfidity | 24.4% |
| Cooking Time | 60 min. |
| Cooking Temperature | 158° C. |
| H Factor | 380 |
| Kappa No. | 45.6 |

After washing the pulp was further delignified with oxygen and bleached in three stages of conventional bleaching (chlorination, extraction and chlorine dioxide).

A comparison cook representing conventional technology was made in a laboratory batch digester using the following conditions:

| | |
|---|---|
| Active Alkali | 15% |
| Sulfidity | 24% |
| Time to Temperature | 90 min. |
| Time at Temperature | 80 min. |
| Cooking Temperature | 164° C. |
| H Factor | 891 |
| Kappa No. | 15.9 |

The pulp was washed and bleached in five stages (chlorination, extraction, chlorine dioxide, extraction and chlorine dioxide). After refining to a comparable pulp drainage, the pulp properties were as follows:

TABLE 2

| | Conventional | Invention |
|---|---|---|
| Bleached Yield, % | 51.4 | 57.3 |
| Pulp Brightness | 87.3 | 90.0 |
| Drainage Time, Secs. | 4.7 | 4.9 |
| C.S. Freeness, ml | 525 | 480 |
| Burst Index, kPam$^2$/g | 2.70 | 2.22 |

TABLE 2-continued

| | Conventional | Invention |
|---|---|---|
| Tear Index, mN.m$^2$/g | 9.14 | 7.59 |
| Tensile Energy Absorbtion, J/m$^2$ | 58.4 | 61.3 |
| Apparent Density, g/cc | 0.66 | 0.59 |
| Opacity | 75.3 | 77.4 |

A gain in bleached pulp yield of 5.9% based on wood, or 11.5%, based on pulp, is indicated for the invention pulp at a higher pulp brightness level. Higher opacity is also evident, despite a higher pulp brightness. This is apparently due to a bulkier sheet.

EXAMPLE 3

Oak chips, which were partially defiberized while being fed into a continuous Sunds Defibrator pilot plant digester, were cooked under the following conditions:

| | |
|---|---|
| Active Alkali | 16.1% |
| Sulfidity | 25.4% |
| Cooking Time | 30 min. |
| Cooking Temperature | 165° C. |
| H Factor | 399 |
| Kappa No. | 33.6 |

The pulp was further delignified with oxygen and bleached in three stages of conventional bleaching (chlorination, extraction and chlorine dioxide).

A conventional cook was made on the same chip supply for comparison using the following conditions:

| | |
|---|---|
| Active Alkali | 17.5% |
| Sulfidity | 27% |
| Time to Temperature | 60 min. |
| Time at Temperature | 60 min. |
| Cooking Temperature | 166° C. |
| H Factor | 845 |
| Kappa No. | 16.7 |

The brownstock from this cook was bleached in three stages of bleaching (chlorination, extraction and chlorine dioxide). Both bleached pulps were refined to several refining levels and handsheets were made. The interpolated properties were as follows at a common sheet density level:

TABLE 3

| | Conventional | Invention |
|---|---|---|
| Bleached Yield, % | 44.8 | 50.2 |
| Pulp Brightness | 89.0 | 89.6 |
| Apparent Density, g/cc | 0.625 | 0.625 |
| Burst Index, kPa m$^2$/g | 3.41 | 3.47 |
| Tear Index, mNm$^2$/g | 10.1 | 7.6 |
| Tensile Index, Nm/g | 57.0 | 54.2 |
| Tensile Energy Absorbtion, J/m$^2$ | 84.1 | 110.9 |
| MIT Fold Endurance | 31 | 76 |
| Opacity | 74.4 | 72.6 |

A gain of 5.4% in bleached yield based on wood, or a 12% gain based on pulp, is indicated, at a slightly higher brightness. On the negative side, there was a reduction in tear strength (from 10.1 to 7.6). However, this is compensated by significantly improved tensile energy absorption and fold ensurance which are often more important in papermaking situations than tear strength. Opacity is slightly lower for the invention pulp but this is partially due to a slightly higher sheet brightness.

EXAMPLE 4

To compare the ease of bleaching, a conventional brownstock and a brownstock according to the teachings of this invention were produced at comparable Kappa numbers. These two brownstocks were bleached in a three stage bleaching sequence (chlorination, extraction and chlorine dioxide) using practically identical bleaching conditions. The bleaching results were as follows:

| | Conventional | Invention |
|---|---|---|
| Kappa No. before bleaching | 23.6 | 25.4 |
| Pulp Brightness, Initial | 77.2 | 90.0 |
| Brightness after aging in oven, 1 hour at 105° C. | 74.9 | 88.2 |
| Post Color Number | 0.84 | 0.23 |

These data indicate much easier bleachability of brownstock made according to the teachings of the invention. This is exhibited in a much higher pulp brighness achieved and in a superior brightness stability as measured by the Post Color Number. Easier bleachability could mean chemical savings and a lower water pollution load from the bleach plant.

EXAMPLE 5

Two conventional Kraft cooks were made in a pilot plant batch digester while holding chips in a wire basket. The cooking conditions were as follows:

| | Low Kappa Cook | High Kappa Cook |
|---|---|---|
| Active Alkali, % | 18.5 | 13 |
| Sulfidity | 25.3 | 25.3 |
| Time to Temperature, min | 90 | 90 |
| Time at Temperature, min | 40 | 40 |
| Cooking Temperature, °C. | 169 | 159 |
| H Factor | 771 | 339 |
| Kappa No. | 23.6 | 70.2 |

After relieving the pressure, the wire basket with the chips was removed from the digester and the chips were defiberized in an 8 inch Bauer mill at 0.008" plate clearance using hot (approx. 80° C.) water at a rate of 6 liters/minute. After washing the high Kappa cook was additionally delignified in two stages of oxygen treatment to a Kappa number of 20.9. No oxygen treatment was done on low Kappa pulp. Both pulps were bleached in a four stage bleaching sequence (chlorination, extraction, hypochlorite and chlorine dioxide). The results were:

| | Low Kappa Cook | High Kappa Cook |
|---|---|---|
| Bleach Yield, % | 46.3 | 45.8 |
| Initial Brightness | 87.6 | 89.7 |

Data indicated that there was no gain in bleached pulp yield when a Kraft cook was stopped at a Kappa No. as high as 70 and oxygen was used for further delignification to a bleachable range. This suggests that the higher yields observed with our technology are primarily due to chip defiberizing prior to cooking and not due to the use of oxygen delignification.

Having described the invention in detial and by reference to preferred embodiments thereof, it will be apparent that modifications and variations are possible without departing from the scope of the invention defined in the appended claims.

What is claimed is:

1. A pulping process comprising the steps of:

partially defiberizing wood chips such that the fibers in said chips are substantially separated from one another but sufficient interfiber bonding points are maintained within said chip to preserve chip integrity and therey provide a chip having an open porous fibrous network;

said wood chips being partially defiberized by passing said chips through a screw press having a compression ratio of about 3/1 to 5/1 under a substantial back pressure;

directly feeding said partially defiberized chips to a digester;

subjecting said partially defiberized chips to chemical pulping at elevated temperature and pressure to provide a pulp having a Kappa value of about 45 to 70;

further delignifying said pulp by reacting said pulp with oxygen in the presence of caustic; and bleaching said pulp.

2. The process of claim 1 wherein said partially defiberized chips are subjected to said chemical pulping liquor under conditions of time and temperature such that the H factor is less than about 400.

3. The process of claim 2 wherein said step of subjecting said chips to chemical pulping is carried out at a temperature less than about 170° C.

4. The process of claim 3 wherein said step of bleaching said pulp includes the step of reacting said pulp with chlorine, chlorine dioxide, or a mixture thereof.

5. The process of claim 4 wherein said partially defiberized chips are subjected to said chemical pulping in a vapor phase digester.

6. The process of claim 5 wherein said chips are hardwood chips.

7. The process of claim 6 wherein said chemical pulping is Kraft pulping.

8. The process of claim 6 of wherein said chemical pulping is soda (AQ) pulping.

9. The process of claim 1 wherein said process includes the additional step of refining said pulp prior to the step of further delignifying said pulp.

10. The pulping process of claim 1 wherein said substantial back pressure is about 100 to 200 psi.

* * * * *